US006551638B1

(12) United States Patent
Dodd et al.

(10) Patent No.: US 6,551,638 B1
(45) Date of Patent: Apr. 22, 2003

(54) METHOD OF PACKAGING A BEVERAGE CONTAINING GAS IN SOLUTION AND A BEVERAGE PACKAGE

(75) Inventors: Carole Jane Dodd, Whitchurch (GB); Robert Purdham, St. Albans (GB); Vivien Jane Sargeant, Waltham Abbey (GB)

(73) Assignee: Guinness Brewing Worldwide Limited, London (GB)

( * ) Notice: Subject to any disclaimer, the term of this patent is extended or adjusted under 35 U.S.C. 154(b) by 0 days.

(21) Appl. No.: 08/999,342

(22) Filed: Dec. 29, 1997

(30) Foreign Application Priority Data

Jan. 8, 1997 (GB) ..... 9700242

(51) Int. Cl.[7] ..... B65B 31/00; B65B 17/00

(52) U.S. Cl. ..... 426/106; 426/112; 426/115; 426/118; 426/124; 426/131; 426/394; 426/397; 426/398; 220/501; 220/502; 53/420

(58) Field of Search ..... 426/106, 112, 426/115, 118, 124, 131, 394, 397, 398, 474; 53/420, 432, 433, 471, 474, 906; 220/501, 521

(56) References Cited

U.S. PATENT DOCUMENTS

| | | | | | |
|---|---|---|---|---|---|
| D318,225 | S | * | 7/1991 | Cassai et al. | D9/355 |
| 5,066,184 | A | * | 11/1991 | Taura et al. | 413/4 |
| 5,230,203 | A | * | 7/1993 | Wu et al. | 53/471 |
| 5,346,095 | A | * | 9/1994 | Deal | 220/669 |
| 5,397,021 | A | * | 3/1995 | Usui | 220/67 |
| 5,620,725 | A | * | 4/1997 | Jamieson et al. | 426/112 |

FOREIGN PATENT DOCUMENTS

| | | | |
|---|---|---|---|
| GB | 2286379 | * | 8/1995 |
| GB | 2286379 A | | 8/1995 |
| GB | 2305159 A | | 4/1997 |
| WO | WO 95/03982 | | 2/1995 |
| WO | 95-03982 | * | 2/1995 |
| WO | WO 95/04688 | | 2/1995 |

* cited by examiner

*Primary Examiner*—Curtis E. Sherrer
(74) *Attorney, Agent, or Firm*—McCormick, Paulding & Huber LLP

(57) ABSTRACT

A method of packaging a beverage having gas in solution and a beverage package has a container 10 containing the beverage 6 to form a headspace 15. Floating on the beverage 6 is a hollow spherical capsule having a restricted aperture 7. During sealing of the container 10 by a top 20 the headspace 15 is pressurised (by a nitrogen dose 16) and during such pressurisation the insert 1 is raised relative to its natural floating position on the beverage 6 to ensure that the aperture 7 communicates with the headspace 15 to pressurise the chamber of that insert. The aforementioned raising of the insert 1 is preferably achieved by subjecting the insert to a centrifugal force during rotation of the container in seaming the top 20 thereto or by magnetic attraction. Following pressurisation of the headspace 15 the insert is lowered to float naturally on the beverage 6 with its aperture 7 submerged. During pressurisation the insert 1 may take in a minimal volume of beverage from the container. When the container is opened by ring pull 25 a pressure differential develops causing fluid under pressure to be ejected from the insert 1 through the aperture 7 into the beverage 6 for liberating gas from solution and the development of froth on the beverage.

20 Claims, 4 Drawing Sheets

METHOD OF PACKAGING A BEVERAGE CONTAINING GAS IN SOLUTION AND A BEVERAGE PACKAGE

TECHNICAL FIELD & BACKGROUND ART

The present invention relates to a method of packaging a beverage containing gas in solution and to a beverage package. More particularly the invention concerns beverage packages of the kind discussed in our U.K. Patent GB-A-2,183,592 in which a sealed container is charged with beverage containing gas in solution and includes a hollow insert having a chamber which communicates with the beverage through a restricted aperture. The hollow insert contains fluid comprising gas under pressure which is in equilibrium with gas at a pressure greater than atmospheric in the headspace of the container. Upon opening the container to dispense the beverage, the headspace is opened to atmosphere which results in a pressure differential causing the pressure of gas in the insert to eject fluid (which may be gas, beverage or froth) from the insert by way of the restricted aperture. The ejected fluid is jetted into the beverage in the container and this causes gas in solution in the beverage to be liberated for the development of froth. The use of hollow inserts in beverage packages for froth development has met with considerable commercial success and since the concept of such an insert (as initially proposed in our aforementioned U.K. Patent) many forms and structures for hollow inserts have been proposed in an attempt to reduce their cost of manufacture and also processing costs for fitting the inserts into the containers. Commercially, beverage packages, typically fermented beers, which include hollow inserts (utilising so-called "widget" technology) are sold by the millions per annum so it will be appreciated that a small saving in the cost of manufacture or fitting of each hollow insert can result in a considerable overall saving per annum. One way of achieving such a saving is by reducing the amount of material required for each hollow insert and also the cost of locating the insert in its container and hollow inserts which float on the beverage lend themselves towards this. A floating insert has the advantage that it can simply be dropped into the container (or otherwise easily deposited) to save on material costs for flanges or other extensions by which the insert is intended to be wedged or otherwise secured at a predetermined position in the container and also in alleviating the requirement for specialised equipment on a filling line to locate (typically wedge) a hollow insert into its container. Where hollow inserts are wedged into a container as aforementioned it is necessary to ensure that the container walls are adequate to withstand the stresses to which they are subjected by the wedging operation. Consequently, where the hollow insert is allowed to float it may be possible to use thinner walled containers and thereby provide a further saving.

Use of hollow inserts which float on the beverage in the container and are loaded, weighted or otherwise ballasted to ensure that the restricted aperture is maintained below the surface of the beverage was originally proposed in our GB-A-2,183,592. Following from that concept many hollow inserts have been proposed, often of a spherical structure, for floating on the beverage but such latter proposals are, typically, of a somewhat expensive and complicated structure and rely upon relatively complex technology for their operation to effect in the jetting of fluid into the beverage to liberate gas from solution in the beverage and the development of froth (upon opening of the container). Examples of such hollow inserts are to be found in Patents GB-A-2,280,886, GB-A-2,280,887, International Publication WO 95/03983 and International Publication WO 95/03982. In these latter publications the hollow inserts may require a sophisticated arrangement of individual chambers and interconnecting passages, the use of non-return valves and the use of displaceable ballasting arrangements or internal wicking devices.

It is now recognised in hollow insert or "widget" technology that the fluid which is ejected from the hollow insert to initiate froth development should, preferably, be predominantly gas under pressure as this provides efficient liberation of gas from solution in the beverage (as compared with such liberation as is achieved predominantly by the ejection of liquid beverage from a floating hollow insert). Hollow inserts are well known which are initially located in the container as a sealed capsule containing gas under pressure but such pre-sealed inserts are expensive. Far less expensive is a hollow insert which derives its gas under pressure (required for ejecting into the beverage to effect froth formation) from the pressurised headspace of the sealed beverage package. With this latter proposal it is essential to ensure that when the headspace is vented to atmosphere upon opening of the beverage package, adequate pressure is available in the insert to provide the necessary pressure differential to develop the jetting effect for froth development and hence the relatively complicated structures and fluid technology employed by the hollow inserts disclosed in the four last mentioned prior Patents. More particularly, a non-return valve permits the chamber of the hollow insert to be pressurised from the headspace of the beverage package through such valve and for gas in the pressurised insert to be ejected through a further non-return valve into the beverage for froth development. The complex system of fluid flow passages and chambers together with the moving ballast and beverage wicking arrangements act so that when the chamber of the floating insert has been pressurised with gas from the headspace of the sealed package, beverage has also been taken into the insert and this causes a change in the ballast which then causes the insert to rotate during its floatation to a condition in readiness for gas to be ejected for froth formation.

It is an object of the present invention to provide a method of packaging a beverage containing gas in solution and also a beverage package of the kind generally discussed above which utilises a floating hollow insert, which will provide for efficient development of froth upon opening of the container, and which lends itself to the use of a hollow insert of a very simple structure capable of relatively inexpensive manufacture.

STATEMENTS OF INVENTION & ADVANTAGES

According to the present invention there is provided a method of packaging a beverage having gas in solution therewith which comprises providing an open topped container having a primary chamber and charging the primary chamber with the beverage to form a headspace; providing in the primary chamber a hollow insert having a secondary chamber and restricted aperture means through which the secondary chamber communicates with the primary chamber, said hollow insert being floatable on the beverage in the primary chamber and being ballasted as provided to the container to an orientation in which the restricted aperture means is at a predetermined disposition relative to the surface of the beverage when floating naturally thereon; closing the open top to seal the primary chamber and pressurising the headspace to a pressure greater than atmospheric, and which further comprises locating the hollow insert in the headspace in a raised position in which it is raised relative to its natural floating position during said pressurisation for location of the restricted aperture means in communication with the headspace and provide in the secondary chamber pressurised fluid comprising gas under pressure derived from the primary chamber and following said fluid pressurisation of the secondary chamber, locating the hollow insert in a lowered position to float naturally on the beverage with the restricted aperture means submerged in the beverage so that when the headspace is open to atmospheric pressure, a pressure differential caused by the decrease in pressure at the headspace causes fluid comprising gas under pressure in the secondary chamber to be ejected by way of the restricted aperture means to jet into the beverage of the primary chamber and said ejection causes gas in solution in the beverage to be evolved for the development of froth on the beverage.

By the present invention it is envisaged that the hollow insert as manufactured and provided to the container will have buoyancy characteristics whereby it will float naturally on the beverage and be ballasted, preferably, to an orientation in which its restricted aperture means (which may comprise one or more apertures) is submerged within the beverage. Alternatively the hollow insert may be ballasted to float naturally on the beverage with its restricted aperture means coinciding with the surface of the beverage or slightly above that surface. During pressurisation of the headspace the hollow insert is located in a raised position (that is a position in which the insert is raised relative to its position when floating naturally on the beverage) sufficiently for the restricted aperture means to communicate with the headspace (or to maintain that communication) and thereby to the gas at greater than atmospheric pressure in the headspace. With the restricted aperture means communicating with the headspace, the secondary chamber will rapidly come into equilibrium with the pressure in the headspace. Following pressurisation of the secondary chamber by gas pressure derived from the headspace of the primary chamber, the hollow insert is located in a lowered position to float naturally on the beverage with its restricted aperture means submerged. In the aforesaid arrangement in which the insert floats naturally with its restricted aperture means coinciding with, or slightly above, the surface of the beverage, it will be necessary for some beverage to be taken into the secondary chamber along with gas from the primary chamber to change the ballasting for the insert to sink slightly deeper into the beverage so that the restricted aperture means will be submerged in the lowered position. When the insert is located in its lowered position (following pressurisation of the secondary chamber) to float naturally on the beverage it is preferred that the insert is in said predetermined orientation. However it will be appreciated that when the secondary chamber takes in beverage from the primary chamber during pressurisation as aforementioned it is possible that the orientation of the insert will change slightly from the orientation it presents when floating naturally prior to pressurisation (and empty of beverage) due to a change in its ballasting caused by the inboard beverage. In its raised position it is not essential for the whole of the hollow insert to be out of the beverage. Provided that in its raised position the insert is sufficiently high relative to the surface of the beverage to expose or increase the exposure of the restricted aperture means to the headspace a bottom part of the insert can remain in the beverage (consequently the depth of the headspace need not be sufficiently large to accommodate the whole of the hollow insert). During pressurisation of the secondary chamber with the hollow insert in its raised position, it is possible (and, under certain conditions, necessary as aforementioned) that a small amount of beverage or froth (which may exist on that beverage in the primary chamber) will be drawn into the secondary chamber. Preferably however any such volume of beverage is arranged to be minimal and is preferably ejected through the restricted aperture means as fluid along with gas for the development of froth on opening of the package. By use of the teaching of the present invention it is possible to pressurise the secondary chamber so that substantially the whole of the fluid that is ejected from the secondary chamber will be a jet of gas derived from the headspace and to alleviate wastage of beverage that may be drawn into the hollow insert and not ejected back into the primary chamber to be dispensed when the package is opened.

A particularly advantageous feature of the present invention is that it lends itself to the use of a hollow insert of extremely simple structure consisting of a shell or capsule defining a single (secondary) chamber and having one or more restricted apertures extending through the shell or capsule wall to communicate with the single chamber, such a hollow insert being ballasted to a natural floating position by a loading or weighting provided by variations in thickness in the wall of the capsule or shell. Such a simple hollow insert is undoubtedly less expensive to manufacture than the prior hollow inserts of the floating type which require non-return valves, numerous chambers and internal passages, displaceable ballasting or beverage wicking arrangements. Preferably the hollow insert is spherical with its secondary chamber defined by a substantially plain internal spherical wall of the insert to be unencumbered, the sphere of the secondary chamber is eccentric with the spherical outer surface of the insert to provide for a variation in wall thickness of the insert and the varying wall thickness is arranged to provide a variation in weight per unit area that will cause the insert to be ballasted to a predetermined orientation when floating naturally on the beverage for the restricted aperture means to be disposed at a predetermined position relative to the surface of the beverage.

In accordance with the method of the present invention the hollow insert may be located in the primary chamber for that insert to float naturally on the beverage in its lowered position and subsequently raised to its raised position prior to pressurisation of the headspace. To achieve this the open topped container may be charged with its beverage and the hollow insert then located in the container to float naturally on that beverage in its lowered position prior to the insert being raised to its raised position, preferably prior to or as the headspace is being pressurised to a pressure greater than atmospheric. Alternatively the hollow insert may be located in the primary chamber prior to that chamber being charged with beverage so that the hollow insert floats on the beverage as the volume of beverage in the primary chamber increases during the formation of the headspace. The raising of the hollow insert from its lowered position when floating naturally to its raised position is preferably achieved by subjecting the insert to a horizontally directed component of force relative to the container to cause the insert to be urged into abutment with a wall of the container which results in the insert being displaced temporarily into its raised position for gas pressurisation of the secondary chamber. To facilitate raising of the insert from its lowered position to its raised position, the wall of the container may present or carry a ramp surface against which the insert abuts to be assisted thereby in moving to its raised position. Such a ramp surface may be presented by a formation in the wall of the container or by a simple angled skirt or other fitment carried within the container. It is preferred that the or a horizontally directed component of force is applied to the insert as a result of the insert being subjected to a centrifugal force following from rotation of the container. Such a centrifugal force may serve to cause the insert to abut the wall of the container as aforementioend and/or cause the insert otherwise to be displaced into its raised condition (possibly due to the development of a vortex in the beverage on which the insert floats). This centrifugal force conveniently results from rotation of the container about its own upstanding axis during sealing of its open top, for example as during a conventional seaming operation for sealing a metallic lid to the open top of an upstanding metallic can.

A less preferred technique for temporarily raising the insert from its lowered position to its raised position or for temporarily retaining the insert in its raised position whilst effecting pressurisation of the secondary chamber is to subject the insert to a vertically directed component of force by magnetic attraction. For such magnetic attraction it will be appreciated that appropriately magnetic material will have to be provided on or in the structure of the hollow insert. This magnetic technique may be particularly suitable for use with non-metallic containers such as glass or plastics bottles or cartons.

The present invention also envisages the possibility of initially locating the hollow insert in the primary chamber in its raised position and maintaining that position during pressurisation of the headspace. With this technique it is likely that the hollow insert will be located initially in its raised position in the primary chamber prior to the primary chamber being charged with the beverage. For example, a container in the form of an open topped can may be delivered to a filling line with the hollow insert already fitted in its raised position, the insert being temporarily retained on a wall of the can. Alternatively the hollow insert may be inserted into the can on the packaging line and temporarily retained at its raised position on a wall of the can for that can to move along the filling line to be charged with beverage. Usually the hollow insert will be retained temporarily on a wall of the container by a food grade adhesive and subsequently released from the adhesive to adopt its lowered position in which it floats naturally on the beverage, such release being achieved, for example, by applying heat to the container, by peristalsis of the wall of the container, or by applying an external shock force to the container as appropriate for the particular adhesive which is selected. Also the insert can be retained in its initial raised position magnetically as previously mentioned or by use of temporary tack adhesives which rapidly decay in the environment of the sealed package.

Preferably the headspace will be pressurised to a pressure greater than atmospheric by subjecting the headspace to a dose of liquid nitrogen in accordance with conventional practice. Following such dosing the open top of the container will be sealed and the contents of the container permitted to come into equilibrium. With liquid nitrogen dosing it is preferred that the insert is located in its raised position prior to or during sealing of the open top of the container and that this raised position is maintained at least until the open top of the container is sealed and substantially the whole of the liquid nitrogen has evaporated. In a conventional beer canning line using liquid nitrogen dosing, the liquid nitrogen dose evaporates extremely rapidly as a can moves towards its sealing station where the open top is closed and sealed by a seaming operation in which the can is rotated about its vertical axis. At the end of the seaming operation it is likely that a major part of the nitrogen dose will have evaporated to pressurise the headspace to a substantial proportion of its final pressure. Conventionally the can rotates about its own axis for the seaming operation and is possibly additionally rotated on a carousel during this operation, conveniently this rotation is employed to subject the hollow insert to a centrifugal force which causes it to move into its raised position in accordance with a preferred method of the present invention.

Further according to the present invention there is provided a beverage package (which package is preferably made by the method of the present invention) comprising a sealed container having a primary chamber containing beverage having gas in solution therewith and forming a headspace comprising gas at a pressure greater than atmospheric; a hollow insert floating on the beverage in the primary chamber, said insert having a secondary chamber containing fluid which comprises gas at a pressure greater than atmospheric, having restricted aperture means through which the secondary chamber communicates with the primary chamber, and being ballasted to a position in which the insert floats naturally on the beverage with the restricted aperture means submerged in the beverage; the package being openable to open the headspace to atmospheric pressure and thereby cause a pressure differential whereby fluid in the secondary chamber is ejected with a jetting effect through the restricted aperture means into the beverage in the primary chamber by the pressure of gas in the secondary chamber and said ejection causes gas in solution in the beverage to be evolved for the formation of froth on the beverage, and wherein the restricted aperture means is arranged so that the jetting effect therefrom is applied with a horizontal component of force or thrust within the beverage and said thrust causes the insert to be displaced in the beverage with a rotary motion about a substantially horizontal axis, said rotary motion resulting in the jetting effect being displaced circumferentially to penetrate deeper into the beverage in the primary chamber and thereby cause gas in solution to be evolved from the beverage over a greater depth than would otherwise be effected without said rotary motion of the insert.

Still further according to the present invention there is provided a beverage package (preferably made by the method of the present invention) comprising a sealed container having a primary chamber containing beverage having gas in solution therewith and forming a headspace comprising gas at pressure greater than atmospheric; a hollow insert floating on the beverage in the primary chamber, said insert having a secondary chamber containing fluid which comprises gas at a pressure greater than atmospheric, having restricted aperture means through which the secondary chamber communicates with the primary chamber and being ballasted to a position in which the insert floats naturally on the beverage with the restricted aperture means submerged in the beverage; the package being openable to open the headspace to atmospheric pressure and thereby cause a pressure differential whereby fluid in the secondary chamber is ejected with a jetting effect through the restricted aperture means into the beverage in the primary chamber by the pressure of gas in the secondary chamber and said ejection causes gas in solution in the beverage to be evolved for the formation of froth on the beverage, and wherein the restricted aperture means is arranged so that the jetting effect therefrom is applied with at least two horizontal components of force or thrust within the beverage and said horizontal components of thrust from the restricted aperture means are directed to restrain the insert from exhibiting rotary motion about a substantially horizontal axis and to maintain the jetting effect directed to a minor depth of the beverage in the primary chamber and thereby cause gas in solution to be evolved from beverage over a lesser depth than would otherwise be effected by deeper penetration of the jetting effect that would result from said rotary motion of the insert.

In the preferred method of the present invention where the hollow insert initially floats on the beverage in its lowered position prior to being raised to its raised position for pressurisation of the secondary chamber, it is preferred that the restricted aperture means is located at a side of the insert remote from its bottom so that, when the insert is floating naturally, the restricted aperture means is positioned slightly below or coinciding with the surface of the beverage—this has the advantage that the insert need only be lifted a little to move from its lowered position to its raised position. With relatively thin walled hollow inserts, particularly of the preferred spherical structure, restricted aperture means on the side of the insert will usually have a horizontally directed component of force in the jetting effect of its fluid. We have determined that for some beverages, particularly stout and ale, the characteristics are such that a relatively large evolution of gas from solution is preferred to develop a considerable froth on the beverage when the package is opened. For other beverages, particularly lager, the characteristics are such that it is preferable for a relatively small proportion of gas in solution in the beverage to be evolved when the package is opened (so that a relatively small head of froth may be provided on the beverage) whilst a considerable proportion of gas is maintained in solution in the beverage to present the beverage with a "sparkle" when it is dispensed into a drinking glass (as discussed in our U.K. Patents GB-A-2,257,107 and GB-A-2,272,201). By the beverage package of the present invention in which the hollow insert is subjected to a rotary motion about a horizontal axis by the jetting effect which is developed when the package is opened, the rotary motion of the hollow insert will displace the restricted aperture means and thereby the jetting effect so that the latter penetrates deeper into the beverage than it would otherwise do. This deep penetration can be used to liberate gas from solution in the beverage over a considerable depth of the beverage for the development of relatively large heads of froth as may be required for beverages such as stout or ale. For the beverage package of the present invention in which the restricted aperture means are disposed so that there are two or more horizontal components of force or thrust from the jetting effect within the beverage and these forces counteract each other to restrain the insert from exhibiting a rotary motion about the horizontal axis, the jetting effect may be maintained at a substantially constant depth. The evolution of gas from the beverage may thereby be restricted to a minor depth of the beverage to form a relatively small head of froth on the beverage whilst a considerable proportion of the beverage may retain its gas in solution as is considered desirable for lager.

DRAWINGS

Embodiments of the present invention will now be described, by way of example only, with reference to the accompanying illustrative drawings, in which:

FIG. 1 is a section through a preferred form of hollow insert for use in the method and beverage package of the invention;

FIGS. 2 to 5 successively illustrate, diagrammatically, the formation of the beverage package utilising the method of the present invention, and the hollow insert shown in FIG. 1;

DETAILED DESCRIPTION OF DRAWINGS

In the following description of the method of packaging a beverage and also of the beverage package, reference will not be made to particular beverage compositions or dimensions as it is realised that such information will be superfluous as being well known or readily discernible to those skilled in the art of beverage package technology of the kind to which the present invention relates, particularly the technology relating to the operation and purpose of the hollow inserts or so-called "widgets".

Figure 1:
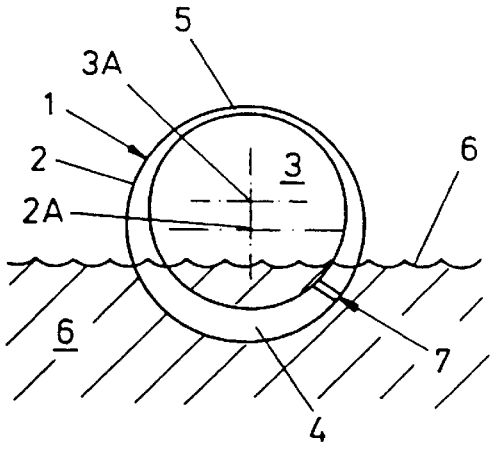

The preferred form of hollow insert for use with the present invention is shown in FIG. 1 and is in the nature of a hollow capsule 1 having a substantially plain spherical outer surface 2 and defining a substantially plain surface spherical secondary chamber 3. The spheres of the surface 2 and chamber 3 are eccentric whereby the sphere of the outer surface 2 has its centre indicated at 2A whilst the spherical chamber 3 has its centre indicated at 3A. The effect of this eccentricity is to provide the capsule 1 with a wall thickness which varies progressively over the surface of the sphere so that the capsule will have a thickened wall region 4 and a thin wall region 5. The thick wall region 4 and relative increase in weight effectively provided over that region (by the greater proportion of material from which the capsule is constructed) provides a ballasting effect so that when the capsule is floated in a beverage 6 containing gas in solution it will adopt and maintain a particular orientation with the heavier ballasting region 4 submerged in the beverage 6. Extending through the wall of the capsule 1 is a restricted aperture 7 by which the secondary chamber 3 communicates with the outside of the capsule. The aperture 7 is formed in the capsule so that when the capsule is floating naturally, the aperture is directed substantially horizontally to coincide with or slightly beneath the surface of the beverage 6 and remote from the bottom of the capsule. The capsule is conveniently formed from two moulded half shells which are bonded or otherwise secured together along a split line which, in FIG. 1, is in a plane extending perpendicularly to the plane of the drawing and through the centres 2A and 3A.

Figure 2:
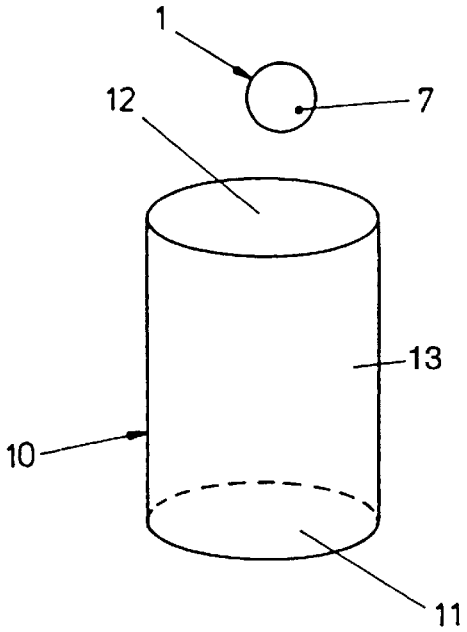
Figure 3:
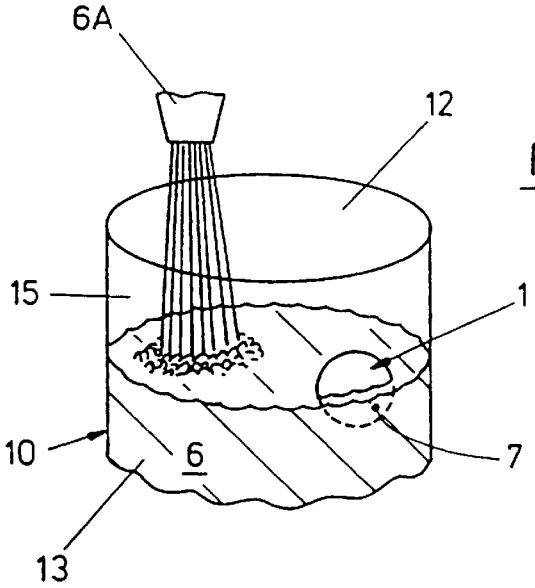

In the present example the beverage 6 containing gas in solution is to be packaged in a primary chamber 13 of a cylindrical metallic can a cylindrical shell for which is shown at 10 (FIG. 2) comprising a base 11 and an open top 12. The open topped container provided by the shell 10 will be displaced along a filling and canning line which may, substantially, be of conventional form subject to minor modifications for placement of the hollow insert or capsule 1. In FIG. 2 a capsule 1 is dropped into the primary chamber 13 following which the primary chamber is charged with the beverage 6 from a nozzle 6A as shown in FIG. 3 so that the capsule 1 floats on the surface of the beverage and rises in the container 10 as the volume of beverage within the primary chamber increases. When the container 10 has received its full charge of beverage 6 a headspace 15 is formed within which is located the capsule 1 floating naturally on the beverage with its restricted aperture 7 coinciding with the surface of the beverage 6 or submerged. A dose 16 (FIG. 4) of liquid nitrogen (derived from a cryogenic unit 17 in conventional manner) is deposited in the headspace 15 and rapidly evaporates. Evaporation of the liquid nitrogen dose 16 serves two purposes; firstly it flushes atmospheric air from the headspace 15 to alleviate contamination/oxidation of the beverage in the sealed package and secondly it pressurises the headspace when the open top 12 of the container is closed and sealed.

Figure 4:
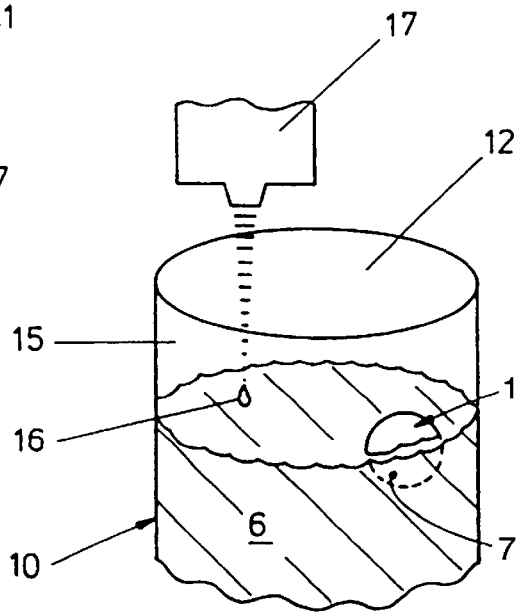

Although the restricted aperture 7 is submerged in the beverage 6 during the filling stages shown in FIGS. 3 and 4, the aperture 7 is so small that, under prevailing atmospheric pressure, a negligible amount, if any, beverage 6 enters the secondary chamber 3 during the short period of the filling stages of FIGS. 3 and 4.

Figure 5:
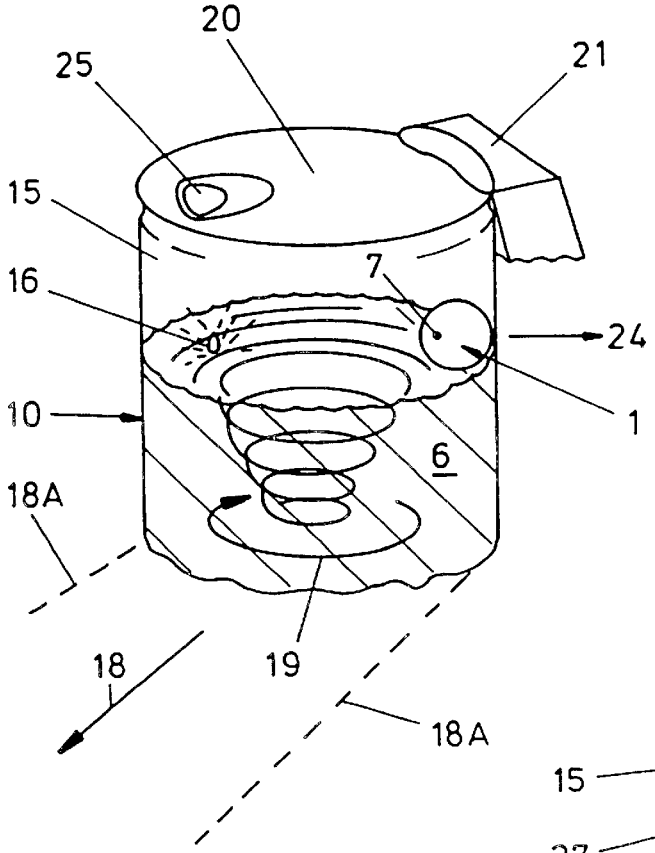

Immediately following the nitrogen dosing stage of FIG. 4, the open topped container 10 moves onto a carousel 18A which rotates to displace the container circumferentially as a whole (as shown in the direction of arrow 18 in FIG. 5) whilst simultaneously subjecting the container to rotation about the upstanding axis of its cylindrical wall—(the latter rotation being indicated by the arrow 19 in FIG. 5). As the open topped container 10 moves onto the carousel to exhibit its rotary movement an end wall or cap 20 is located to close the open top 12 and the rotation of the can in the direction of arrow 19 is to facilitate sealing of the top end wall 20 to the cylindrical wall of the container 10 by a conventional seaming operation with a seaming unit 21. Whilst the top end wall 20 is being sealed to close the open top of the container 10, the liquid nitrogen dose 16 continues to evaporate and the pressure of gas in the headspace 15 progressively increases. During rotary motion of the container 10 (which motion is a combination of the rotation of the container about its own cylindrical axis as indicated at 19 and rotation of the container as a whole on the carousel as indicated at 18), the capsule 1 is subjected to a centrifugal force displacing it over the surface of the beverage 6 and relative to the container 10 as indicated by the arrow 24 in FIG. 5. Following from this centrifugal force the capsule 1 is caused to abut the cylindrical side wall of the container 10. It has been found that the centrifugal force 24 and the reaction of the capsule 1 abutting the cylindrical side wall, together with, it is believed, an effect resulting from a vortex created by the rotating beverage 6, has the effect of lifting the capsule 1 from its natural floating or lowered position on the beverage 6 to a raised position shown in FIG. 5. In this raised position the capsule is lifted sufficiently for the normally submerged restricted aperture 7 to communicate directly with the gas in the headspace 15 and this raised position of the capsule 1 is maintained whilst the centrifugal force 24 is maintained. It will be appreciated therefore that as the pressure in the headspace 15 increases as a result of evaporation of the liquid nitrogen dose 16, the pressure within the secondary chamber 3 of the capsule increases similarly to maintain the equilibrium during and following sealing of the open top of the container. When the headspace 15 and secondary chamber 3 have been pressurised to a major proportion (if not to the final pressure) of the pressure greater than atmospheric which the headspace 15 is to attain, the sealed package may cease its rotary motion and move off the carousel causing the capsule 1 to fall into its lowered or natural floating position in which it is orientated by its ballasting to locate the restricted aperture 7 submerged in the beverage 6. Preferably the capsule 1 will have attained its raised position prior to the pressure in the headspace 15 increasing sufficiently to cause beverage to enter the secondary chamber 3 through the restricted aperture—it is appreciated however that a minimal amount of beverage or froth may enter the capsule 1—at least to ensure that in its natural floating position the restricted aperture 7 is submerged with the insert 1 in the same orientation as that in which it initially floats naturally on the beverage 6. Also some beverage or froth may enter the capsule 1 as the contents of the package pass through the final stage of coming into equilibrium following removal of the beverage package from the carousel 18, however the total volume of the beverage which may enter the secondary chamber 3 as the sealed package comes into equilibrium is appreciably less than the volume of such beverage which would otherwise have entered the secondary chamber 3 had the insert not have been subjected to gas pressure from the headspace 15 whilst in its raised position.

Figure 6:
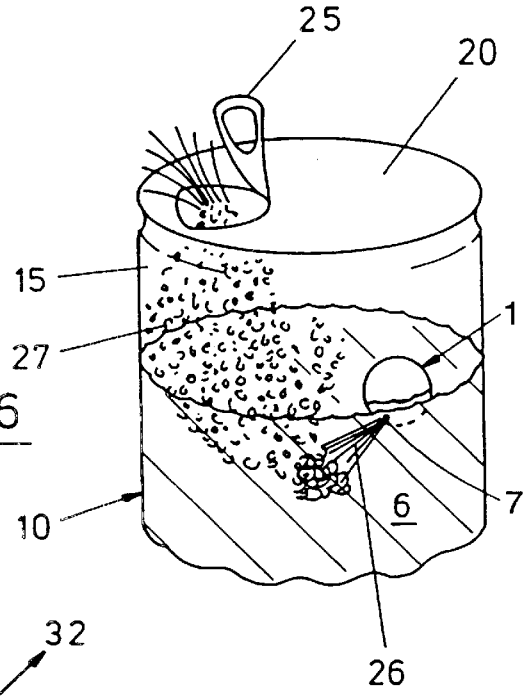
FIG. 6 illustrates the reaction of a beverage package made by the method discussed with reference to FIGS. 2 to 5 upon being opened.

The top wall 20 which is sealed to the container is provided with a ring pull 25 (or other convenient means for opening the package). Upon opening the package as shown in FIG. 6 the headspace 15 is reduced to atmospheric pressure through the opening created by the ring pull. As a result a pressure differential develops whereby the pressure of gas greater than atmospheric within the secondary chamber 3 of the capsule causes fluid in the secondary chamber to be ejected from the capsule by way of the restricted aperture 7 to provide a jetting effect 26 into the beverage 6. This jetting effect results in gas being liberated from solution in the beverage for the development of froth 27 in the headspace. The fluid that is ejected from the capsule through the restricted aperture 7 to effect in froth development is predominantly or wholly gas although it is appreciated that a relatively small amount of beverage or froth may also be ejected through the aperture 7.

Figure 7:
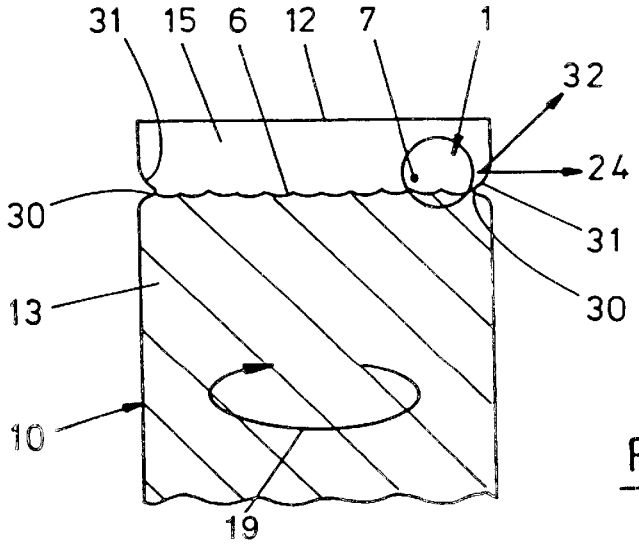
FIG. 7 shows a modification for the container in the method described with reference to FIGS. 1 to 5.

To ensure that in the sealed package the secondary chamber 3 of the capsule contains gas under pressure with minimal, if any, beverage it is important to ensure that the restricted aperture 7 is in its raised position for a substantial period from the commencement of and during pressurisation of the headspace 15. Whilst we have found that the abutment between the capsule 1 and the cylindrical wall of the open topped container 10 under the centrifugal force 24 that is applied to the capsule will usually create sufficient lift to displace the capsule to its raised position, if necessary the open topped container 10 can be modified to facilitate the lifting of the capsule to its raised position. Such a modification is shown in FIG. 7 where the wall of the container 10 is provided with an annular external recess 30 that extends about the periphery of the cylindrical wall and presents an internal upwardly directed ramp surface 31. The ramp surface 31 is located so that as the capsule 1 abuts the side wall of the container 10, it can co-operate with the ramp surface 31 to ride up that surface (as shown by arrow 32) in response to the centrifugal force 24 to lift the capsule relative to the beverage 6, causing the restricted aperture 7 to emerge from the beverage as the capsule approaches its raised position. Rather than having a recess 30 in the wall of the container 10, the ramp surface 31 may be provided by an angled skirt or similar fitment (not shown) carried within the container.

Figure 8:
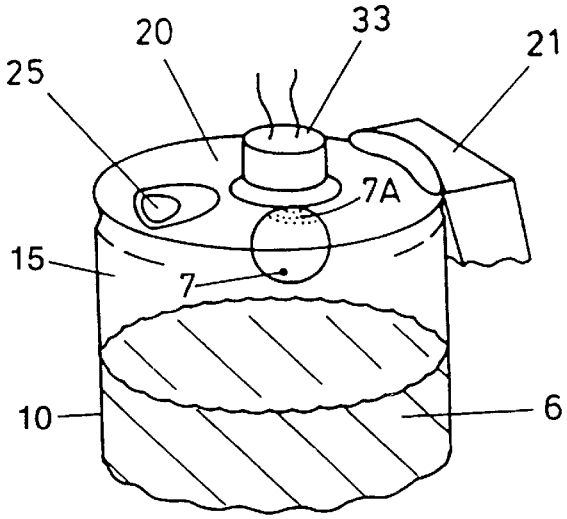
FIG. 8 shows a modification in which the hollow insert is lifted magnetically from its lowered position to its raised position.

As an alternative to relying upon centrifugal force to displace the capsule 1 from its lowered or natural floating position to its raised position, the capsule may carry or be impregnated with magnetic material 7A by which the capsule may be attracted to a permanent magnet or an electro magnet 33 (see FIG. 8) to hold the capsule in its raised position as the headspace 15 is pressurised following the liquid nitrogen dosing. In FIG. 8 the capsule is shown being held in its raised position by the electro magnet 33 as the open top of the container is being sealed to the cylindrical side wall 10 by the seaming unit 21.

Figure 9:
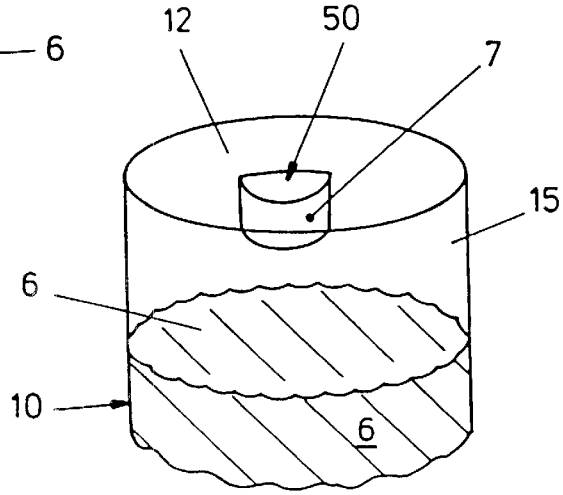
FIG. 9 shows a modified form of container in which the hollow insert is initially located in the container in its raised position.
Figure 10:
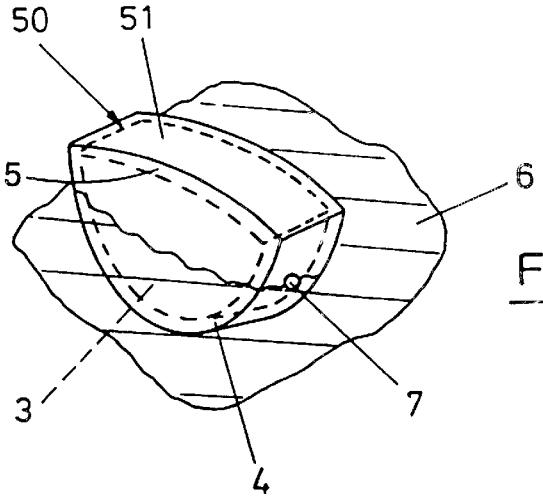
FIG. 10 shows the insert of FIG. 9 when in its lowered position floating naturally in the beverage.
Figure 11:
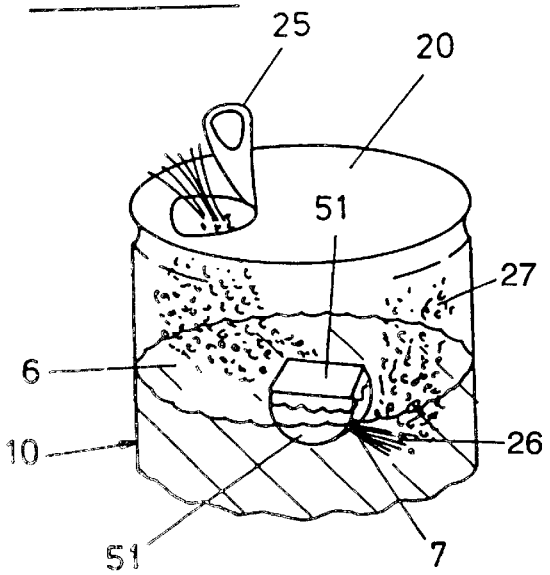
FIG. 11 shows a beverage package comprising the insert of FIGS. 9 and 10 reacting upon being opened.

In the arrangement shown in FIG. 9 a hollow insert shown at 50 with its restricted aperture 7 is initially secured to the internal surface of the cylindrical wall of the container 10 at a position that will correspond to the headspace 15. With the insert 50 so secured the container 10 is charged with beverage 6 and subjected to the pressurisation and sealing stages similar to those previously discussed with reference to FIGS. 4 and 5. Following pressurisation of the sealed headspace 15 and when the contents of the package substantially come into equilibrium, the insert 50 is released from the side wall 10 to drop into the beverage 6 and adopt its natural floating or lowered position. The hollow insert 50 is best seen in FIG. 10 in its natural floating position with the restricted aperture 7 submerged. The purpose of the insert 50 is identical to that of the capsule 1 although its shape has been changed as convenient for temporary attachment to the container wall. More particularly the insert 50 has a part cylindrical surface 51 which corresponds to the cylindrical internal surface of the open topped container 10 to which it may be secured in face-to-face contact by a food grade adhesive. The part of the insert 50 projecting from the surface 51 may be part cylindrical (say conforming to the lower half of the capsule shown in FIG. 1) with a side wall of varying thickness to provide the required ballasting. The capsule 50 may be released from the side wall 10 by massaging of that side wall, by a shock force or by subjecting the package to heat, for example during pasteurisation of the beverage in the package, where the adhesive is of a thermally degradable kind. FIG. 11 shows the package containing the insert 50 reacting upon being opened to cause gas at a pressure greater than atmospheric to be ejected from the insert for the resultant jet to liberate gas from solution in the beverage 6 for the development of froth.

Figure 12:
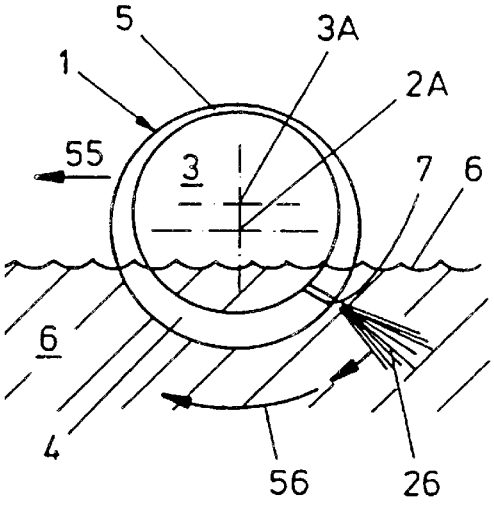
FIG. 12 shows a hollow insert similar to that shown in FIG. 1 and reacting in response to its beverage package being opened to provide a deep thrusting jetting effect.

FIG. 12 shows the spherical capsule 1 in operation to create the gas jet 26 during opening of the package and it will be seen that the jetting effect 26 will impart a horizontal thrust to the capsule 1 causing it to be displaced in the direction of arrow 55 over the surface of the beverage 6. Furthermore, the thrust from the jetting effect 26 is located below the centre of the spherical surface 2 and is arranged to cause a rotary motion to be imparted to the capsule 1 in the direction of arrow 56 whereby the capsule effectively exhibits rotation about a horizontal axis. During this rotary motion the fluid jet 26 is displaced arcuately through the beverage 6 to progressively increase its penetration into the depth of the beverage from that shown in FIG. 12. As a consequence, the jetting effect 26 causes gas to be liberated from solution in the beverage 6 over a depth of the beverage which may be far greater than that which would otherwise be attained (without the capsule exhibiting its rotary motion). By this arrangement it may be possible to liberate gas in solution from a major proportion of the beverage in the container and thereby create a considerable head of froth (as may be regarded as desirable for stout and ale).

Figure 13:
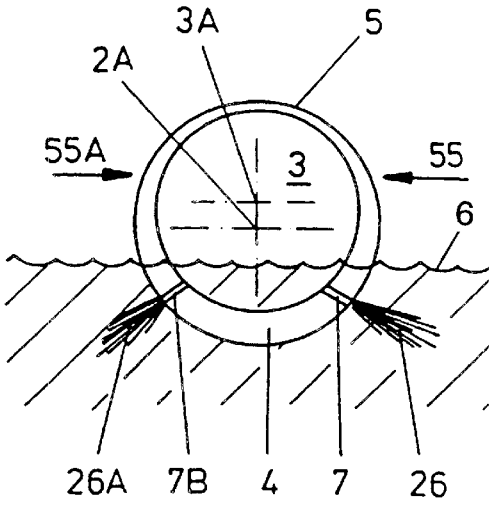
FIG. 13 shows a hollow insert similar to that of FIG. 12 but modified to restrict its jetting effect to a shallow region of the beverage.

FIG. 13 shows a modified form of the capsule 1 whereby two restricted apertures 7 and 7B are provided, the two restricted apertures being located directly opposite to each other. The restricted aperture 7B serves the same function as the aperture 7 in so far as when the beverage package is opened and the capsule 1 is subjected to a pressure differential, gas under pressure is ejected as a jet 26A from the restricted aperture 7B for froth development. The jetting effect 26A provides a horizontal thrust 55A on the capsule 1 which directly opposes and counteracts the horizontal thrust 55 which is applied to the capsule by the jet effect 26. As a consequence of the substantially equal and opposing thrusts 55 and 55A, the capsule 1 in FIG. 13 is restrained from rotating about a substantially horizontal axis (in the manner previously discussed with reference to FIG. 12) and the generally horizontally directed opposed jets 26 and 26A are restricted to liberating gas from solution in the beverage 6 over a relatively shallow region of the beverage 6 so that a relatively small amount of froth will develop in the headspace 15. By this technique a relatively large or deep volume of the beverage beneath the jets 26 and 26A may retain gas in solution to provide a sparkle effect when the beverage is dispensed into a transparent glass (as may be considered desirable for lager). Although only two restricted apertures have been shown in FIG. 13 it will be appreciated that more than two such peripherally spaced apertures may be provided which are symmetrically disposed about the capsule 1 so that the gas jets from the restricted apertures counteract each other to restrain the capsule from rotating about a horizontal axis. It will be appreciated that in the arrangement shown in FIG. 13 the principle object is to restrain the capsule 1 from rotating about a horizontal axis, however it is possible for the capsule to exhibit rotation about a vertical axis in the event that the thrusts from the restricted apertures are directed appropriately.

Although in each of the above described arrangements a single restricted aperture 7 or 7B has been referred to it will be appreciated that such a single aperture may be replaced by a closely spaced array of apertures.

Figure 14:
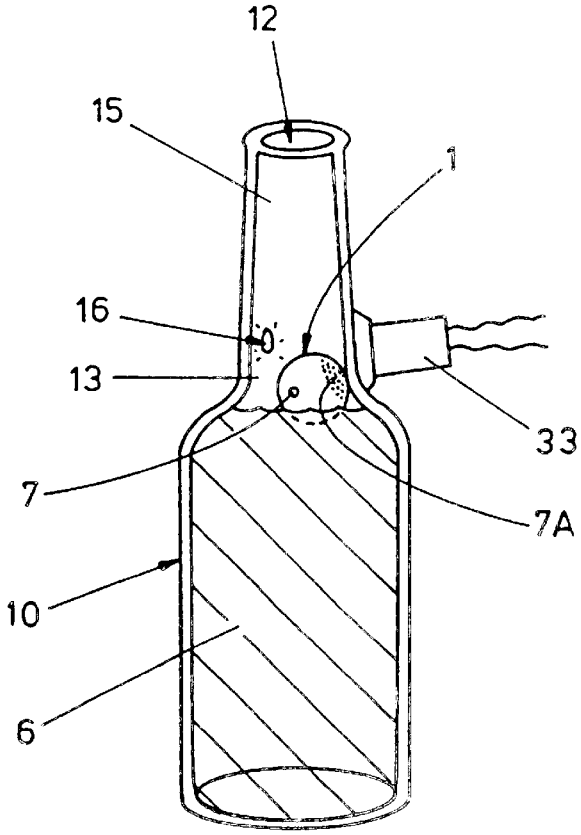
FIG. 14 shows a modification of the invention in FIG. 8 and for use with a glass bottle container.

The present invention was primarily developed for use with containers in the form of thin walled metallic cans but it will be appreciated that the method may readily be adapted for use with other forms of container such as plastics or glass bottles or cartons. For example, FIG. 14 shows a container in the form of a glass bottle 10 immediately prior to its open top 12 being sealed (usually by a crown closure) and in which the hollow insert/capsule 1 is temporarily retained in its raised position by attraction with an electromagnet 33 in a similar manner to that shown in FIG. 8.

What is claimed is:

1. A method of packaging a beverage having gas in solution therewith which comprises providing an open topped container having a primary chamber; charging the primary chamber with the beverage to form a headspace; providing in the primary chamber a hollow insert having a secondary chamber and restricted aperture means through which the secondary chamber is in communication with the primary chamber said hollow insert being floatable on the beverage in the primary chamber and being ballasted as provided to the container to an orientation in which the restricted aperture means will be submerged in the beverage when closing the open top to seal the primary chamber and pressurizing the headspace to a pressure greater than atmospheric, and which further comprises locating the hollow insert in the headspace in a raised position in which it is raised relative to the surface of the beverage during said pressurization for location of the restricted aperture means in communication with the headspace to provide in the secondary chamber pressurized fluid comprising gas under pressure derived from the primary chamber and following said fluid pressurization of the secondary chamber, locating the hollow insert in a lowered position to float on the beverage with the restricted aperture means submerged in the beverage so that when the headspace is opened to atmospheric pressure, a pressure differential caused by the decrease in pressure at the headspace causes fluid comprising gas under pressure in the secondary chamber to be ejected by way of the restricted aperture means to jet into the beverage of the primary chamber and said ejection causes gas in solution in the beverage to be evolved for the development of froth on the beverage.

2. A method as claimed in claim 1 which comprises locating the hollow insert in the primary chamber prior to charging the primary chamber with beverage so that the hollow insert floats on the beverage to rise in the primary chamber as the volume of beverage therein increases during the formation of the headspace.

3. A method as claimed in claim 1 which comprises subjecting the hollow insert to a horizontally directed component of force relative to the container to urge the insert into abutment with a wall of the container which abutment causes the insert to be displaced into its raised position.

4. A method as claimed in claim 3 in which the wall of the container presents a ramp surface with which the insert co-operates by said abutment and said ramp surface assists in raising the insert to its raised position.

5. A method as claimed in claim 1 which comprises subjecting the hollow insert to a horizontally directed component of force, said force resulting from the insert being subjected to a centrifugal force following from rotation of the container, said centrifugal force causing the insert to be displaced into its raised position.

6. A method as claimed in claim 5 in which the container is generally cylindrical having an upstanding axis about which it is rotated to subject the insert to the centrifugal force.

7. A method as claimed in claim 5 in which the container is subjected to a rotation to provide the centrifugal force during sealing of the open top by a seaming process.

8. A method as claimed in claim 1 which comprises subjecting the hollow insert to a vertically directed component of force to displace the insert from its lowered position to its raised position by magnetic attraction of the insert.

9. A method as claimed in claim 1 which comprises initially locating the hollow insert in the primary chamber in its said raised position and maintaining that position at least during initial pressurisation of the headspace.

10. A method as claimed in claim 9 which comprises initially locating the hollow insert in its said raised position prior to the primary chamber being charged with the beverage.

11. A method as claimed in claim 9 which comprises locating the hollow insert in its said initial raised position by temporarily retaining the insert on a wall of the container.

12. A method as claimed in claim 11 in which the wall on which the insert is retained is an upstanding side wall of the container.

13. A method as claimed in claim 11 in which the insert is temporarily retained by adhesive.

14. A method as claimed in claim 13 in which the insert is released from said adhesive to fall into its lowered position by subjecting the adhesive to heat.

15. A method as claimed in claim 14 in which the heat is derived during pasteurisation of the beverage in the sealed package.

16. A method as claimed in claim 11 in which the insert is temporarily retained magnetically.

17. A method as claimed in claim 1 which comprises ballasting the insert by regional weighting of the insert caused by a locally thickened region in the wall thickness of the insert.

18. A method as claimed in claim 1 in which the insert has a spherical outer surface and the secondary chamber is spherical, the center of the secondary chamber being eccentric with center of the sphere of the outer surface to provide the insert with a wall of varying thickness which variations in thickness serve to ballast the insert to a position in which it floats naturally on the beverage with the restricted aperture means submerged in the beverage.

19. A method as claimed in claim 1 which comprises pressurising the headspace by subjecting it to a dose of liquid nitrogen, sealing the open top and allowing the contents of the container to come into equilibrium.

20. A method as claimed in claim 19 in which the hollow insert s provided to the container is ballasted so that when floating naturally on the beverage said restricted aperture means is submerged in the beverage.

* * * * *